US006769394B2

(12) United States Patent
Radel et al.

(10) Patent No.: US 6,769,394 B2
(45) Date of Patent: Aug. 3, 2004

(54) METHOD FOR CONTROLLING THE FUEL SUPPLY TO AN INTERNAL COMBUSTION ENGINE

(75) Inventors: Harry Radel, Geesthacht (DE); Andreas Krueger, Hamburg (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 10/225,753

(22) Filed: Aug. 20, 2002

(65) Prior Publication Data

US 2004/0035389 A1 Feb. 26, 2004

(30) Foreign Application Priority Data

Aug. 20, 2001 (DE) ..... 101 39 880

(51) Int. Cl.[7] ..... F02D 9/06
(52) U.S. Cl. ..... 123/325; 701/96
(58) Field of Search ..... 123/325, 332, 123/339.1, 352, 481, 492, 493, 198 F, 394; 701/96, 79

(56) References Cited

U.S. PATENT DOCUMENTS 5,222,022 A * 6/1993 Adams et al. ..... 701/110
5,450,828 A * 9/1995 Sakamoto et al. ..... 123/339.11
5,542,389 A * 8/1996 Miyamoto et al. ..... 123/339.1
5,758,616 A * 6/1998 Motose ..... 123/198 F
6,094,615 A * 7/2000 Park ..... 701/96
6,317,678 B1 * 11/2001 Linden ..... 701/94
6,321,722 B1 * 11/2001 Nakano ..... 123/493
6,615,797 B2 * 9/2003 Richard et al. ..... 123/352

FOREIGN PATENT DOCUMENTS

DE 32 50 056 C2 7/1991
DE 39 23 237 C2 1/1994
DE 198 52 218 C2 6/2001

OTHER PUBLICATIONS

Trankler, H.R.: Taschenbuch der Messtechnik mit Schwerpunkt Sensortechnik; 1990; pp. 137–139.

* cited by examiner

*Primary Examiner*—Mahmoud Gimie
(74) *Attorney, Agent, or Firm*—McCormick, Paulding & Huber LLP

(57) ABSTRACT

With a method for controlling the fuel supply to an internal combustion engine, in particular to a two-stroke motor, a parameter (K) of the machine, which is influenced by the fuel supply in a delayed manner, is tuned to a predetermined desired value (SW) by switching on and cutting off the fuel supply. The hysteresis is largely compensated in that an upper and/or lower threshhold value (OS,US) is allocated to the desired value (SW) of the parameter (K), that the parameter (K) is continuously measured, and that the fuel supply is cut off when the measured parameter (K) crosses the lower and/or upper threshhold value from below to above, and that the fuel supply is switched on when the measured parameter (K) crosses the upper and/or lower threshhold value (OS,US) from above to below.

13 Claims, 1 Drawing Sheet

METHOD FOR CONTROLLING THE FUEL SUPPLY TO AN INTERNAL COMBUSTION ENGINE

FIELD OF THE INVENTION

The present invention relates to the field of internal combustion engines. It relates to a method for controlling the fuel supply to an internal combustion engine, in particular to a two-stroke motor.

BACKGROUND OF THE INVENTION

In motor apparatus such as for example a chain saw usually the highest rotational speed is limited by overenriching the air/fuel mixture, which leads to spark failures (known under the name "four-stroking"). Another way is the direct influencing of the combustion via an ignition cut-off on reaching a defined (maximum) rotational speed. These variants without additional measures however lead to the fact that unburnt fuel leaves the motor. This in turn not only directly leads to an undesired high emission of hydrocarbons, but also indirectly limits the possibility of the application of a catalytic converter, since the unburnt fuel contributes to overheating and thus to the destruction of the catalytic converter.

In order to exclude such overenrichment, in the automobile branch one has applied rotational speed limitations by way of fuel cut-offs. These may be realized in the manner of a controllable intake-manifold injection or also by way of a carburetor control via a nozzle cut-off valve. In motor apparatus with two-stroke motors however stored quantities of fuel in the crank housing and intake pipe lead to an undesired hysteresis about the governing rotational speed. With this, rotational speed fluctuations of approx. ±700 1/min occur.

From DE-Al-39 11 016 there is known a method for operating a two-stroke internal combustion engine with which the fuel injection on idling and in the low part-load region is effected intermittently, wherein the fuel is injected during a constant angle of opening with a constant volume flow. If the rotational speed changes thus e.g. drifts away, the time during which the rotational angle is run through changes, and specifically inversely proportional to the rotational speed. From this there results a self-regulation of the rotational speed in that specifically with an increase in the rotational speed the quantity of injected fuel recedes or with a fall in the rotational speed the time duration of the fuel injection is increased and thus the quantity of the fuel injected with a constant volume flow increases. Such a direct self-regulation acting without a time delay is however only possible when the fuel is injected directly into the cylinder in an electronically controlled manner.

In DE-Al-199 21 020 there is described a method and a device for control of the fuel supply with a model motor with a fuel injection into the crank housing, with which the injection period required for a demanded quantity of fuel per cycle is determined in each case. If with low rotational speeds the determined injection period drops below a given minimal injection period, the continuous injection is switched over to an intermittent injection, wherein the injection data for the intermittent injection is deduced from a stored correspondence table. With high rotational speeds a hysteresis may also not be avoided here.

EP-131-0 715 686 discloses a method for controlling an internal combustion engine in which the air/fuel ratio is continuously automatically adapted to the operating condition, in order for example to achieve a maximal efficiency, maximum exploitation of the fuel and a rotational speed limitation. For this, periodically for a short time, e.g. by cutting off the supply of fuel, the air/fuel ratio is changed and the influence of this change on the rotational sped is measured. Additionally, the rotational speed which is not yet influenced, shortly after the change, and the influenced rotational speed after the effect of the change, i.e. after a few revolutions, are measured and compared to one another. The result of this comparison is used for optimizing the air/fuel ratio via a setting device. With this type of control the hysteresis is considerable.

SUMMARY OF THE INVENTION

It is therefore the object of the invention to specify a method for the control of the fuel supply of an internal combustion engine, which is simple to realize and largely avoids hysteresis effects with the parameters of the machine influenced by the supply of fuel, such as e.g. the rotational speed.

The core of the invention lies in the fact that the fuel supply in each case is already switched over (switched-on or cut-off) before the desired value of the parameter is reached coming from above or below. By way of this, fluctuations about the desired value are limited to a (narrow) band which may be set, and the hysteresis is largely compensated.

The method is particularly simple when according to a preferred formation of the invention the upper or lower threshhold value are equally distanced from the desired value. This above all is the case when the dependence of the parameter on the fuel supply is largely linear in the region of the desired value.

Preferably the parameter is the rotational speed of the internal combustion engine. The rotational speed fluctuations are limited to a small rotational band by way of the control according to the invention, by which means the rotational speed hysteresis is limited and the emission of hydrocarbons is kept small.

This is particularly the case when according to a further formation of the invention the desired value of the rotational speed is the desired governing rotational speed.

A help with the governing of the rotational speed may furthermore be achieved if additionally to the cutting-off or switching-on of the fuel supply, the ignition sparks for igniting the fuel/air mixture is switched off or on.

It is however also conceivable for the desired value of the rotational speed to be the idling rotational speed. A switch-over to the idling rotational speed as a desired value is particularly simple when the internal combustion engine comprises a throttle valve which on idling of the machine assumes an idling position, and if one takes the idling rotational speed as the desired value of the rotational speed when the throttle valve is located in the idling position.

BRIEF DESCRIPTION OF THE DRAWINGS

The invention is hereinafter described in more detail by way of embodiment examples in combination with the drawing.

DETAILED DESCRIPTION OF THE PREFERRED EMBODIMENTS

Figure 1:
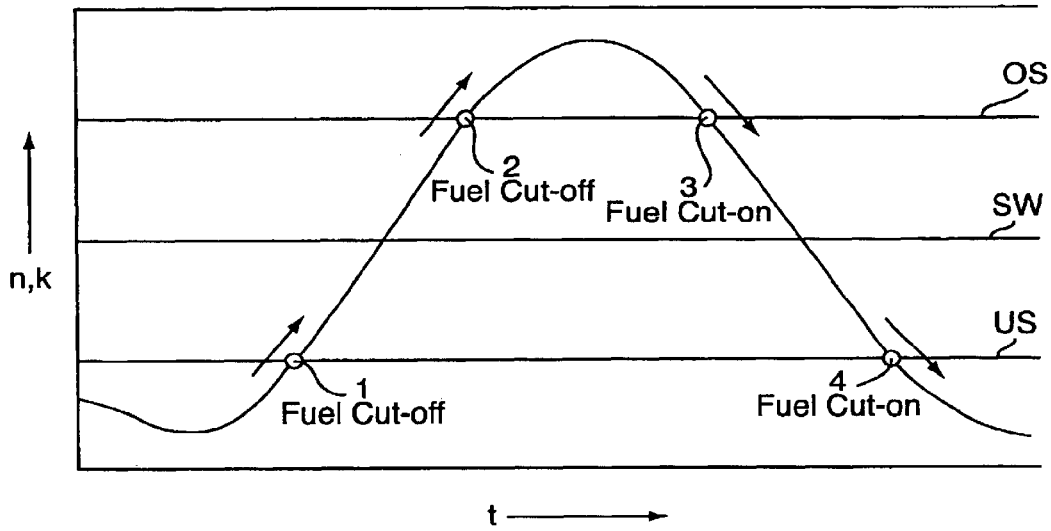
FIG. 1 illustrates a diagram for one preferred embodiment example of the invention in which the rotational speed is tuned to the desired governing rotational speed.

In FIG. 1 the rotational speed n of an internal combustion engine, in particular of a two-stroke motor, is drawn as a curve over the time t. The rotational speed n at the same time is a particular case of a parameter K of the machine. Other parameters may for example be the pressure, the temperature, the vibration of the machine or likewise.

The wave-like curve fluctuates about a desired value SW which in the example is equal to the desired governing rotational speed. At a predetermined distance above the desired value SW one fixes an upper threshhold value. At a predetermined distance below the desired value one fixed a lower threshhold value US. Both distances may, but do not have to be equal.

According to the invention now the rotational speed hysteresis, i.e. the overshoot of the n(t) curve beyond or below the desired value SW is reduced in that the switching-on or cutting-off of the fuel is carried out before crossing the desired value, the governing desired speed in the example, so that the hysteresis is largely compensated. For this the desired governing rotational speed is replaced by the upper and/or lower threshhold value OS and US respectively. If one of these threshhold values OS, US is crossed with an increasing rotational speed (points 1 and 2 in the Figures, arrow upwards), then the fuel supply is interrupted. On crossing the threshhold values OS, US with a reducing rotational speed (points 3 and 4 in the Figure; arrow downwards) the fuel supply is again switched on.

This control may not only be applied for limiting the highest rotational speed, but also for stabilizing the idling rotational speed. With this however, information to the extent that the throttle valve is located in the idling position must be present.

The described control in the governing range (i.e. on limiting the highest rotational speed) may be additionally assisted by switching the ignition spark on or off.

Of course the control is not limited to two-stroke motors and rotational speeds as the parameter, but may be advantageously applied to all internal combustion engines and all parameters which are dependent on the fuel supply in a delayed manner.

List of Reference Numerals

| | |
|---|---|
| SW | desired value |
| OS | upper threshhold value |
| US | lower threshhold value |
| t | time |
| n | rotational speed |
| K | parameter |

What is claimed is:

1. A method for controlling the fuel supply to an internal combustion engine, in particular a two-stroke motor, with which method a parameter (K) of the machine which is influenced in a delayed manner by the fuel supply, is tuned to a predetermined desired value (SW) by switching on and cutting off the fuel supply, characterized in that an upper and/or a lower threshold value (OS,US) is allocated to the desired value (SW) of the parameter (K), that the parameter (K) is continuously measured, and that the fuel supply is cut off when the measured parameter (K) crosses the lower and/or upper threshold value (US,OS) from below to above, and that the fuel supply is switched on when the measured parameter (K) crosses the upper and/or lower threshold value (OS,US) from above to below.

2. The method according to claim 1, characterized in that the upper and/or lower threshold value (OS,US) are equally distanced from the desired value (SW).

3. The method according to claim 1, characterized in that the parameter (K) is the rotational speed (n) of the internal combustion engine.

4. The method according to claim 3, characterized in that the desired value (SW) of the rotational speed(s) is the desired governing rotational speed.

5. The method according to claim 4, characterized in that additionally for cuffing off or switching on the fuel supply, the ignition spark for igniting the fuel/air mixture is also cut off or switched on.

6. The method according to claim 3, characterized in that the desired value (SW) of the rotational speed(s) is the idling rotational speed.

7. The method according to claim 6, characterized in that the internal combustion engine comprises a throttle valve which on idling of the machine assumes an idling position, and that the idling rotational speed is taken as the desired value (SW) of the rotational speed(s) when the throttle valve is located in the idling position.

8. The method according to claim 2, characterized in that the parameter (K) is the rotational speed (n) of the internal combustion engine.

9. The method according to claim 8, characterized in that the desired value (SW) of the rotational speed(s) is the desired governing rotational speed.

10. The method according to claim 9, characterized in that additionally for cuffing off or switching on the fuel supply, the ignition spark for igniting the fuel/air mixture is also cut off or switched on.

11. The method according to claim 8, characterized in that the desired value (SW) of the rotational speed(s) is the idling rotational speed.

12. The method according to claim 11, characterized in that the internal combustion engine comprises a throttle valve which on idling of the machine assumes an idling position, and that the idling rotational speed is taken as the desired value (SW) of the rotational speed(s) when the throttle valve is located in the idling position.

13. A method for controlling the fuel supply to a two-cycle internal combustion engine with which method a rotational speed of the two-cycle internal combustion engine is influenced in a delayed manner by the fuel supply, is tuned to a desired governing rotational speed by switching on and cutting off the fuel supply, characterized in that an upper and/or a lower threshold value is allocated to the desired governing rotational speed of the rotational speed of the two-cycle internal combustion engine, that the rotational speed of the two-cycle internal combustion engine is continuously measured, and that the fuel supply is cut off when the measured rotational speed of the two-cycle internal combustion engine crosses the lower and/or upper threshold value from below to above, and that the fuel supply is switched on when the measured rotational speed of the two-cycle internal combustion engine crosses the upper and/or lower threshold value from above to below.

* * * * *